United States Patent [19]

Kern et al.

[11] Patent Number: 4,457,725

[45] Date of Patent: Jul. 3, 1984

[54] HYDRAULIC TRIM TILE SYSTEM FOR OUTBOARD PROPULSION UNITS USING A PRESSURE AMPLIFIER

[76] Inventors: Calvin V. Kern, 629 Brahier La., Maumee, Ohio 43537; Lawrence P. Zepp, 230 Liberty St., Bowling Green, Ohio 43402

[21] Appl. No.: 293,766

[22] Filed: Aug. 17, 1981

Related U.S. Application Data

[63] Continuation of Ser. No. 70,378, Aug. 27, 1979, abandoned.

[51] Int. Cl.[3] ..... B63H 21/26

[52] U.S. Cl. ..... 440/61; 60/560/564

[58] Field of Search ..... 440/53, 61; 60/560, 60/563, 564, 574

[56] References Cited

U.S. PATENT DOCUMENTS

| | | | |
|---|---|---|---|
| 1,970,999 | 8/1934 | Ferris et al. | 60/563 |
| 3,473,328 | 10/1969 | Mayhew | 60/563 |
| 3,581,702 | 6/1971 | Moberg | 440/61 |
| 3,659,420 | 5/1972 | Reinecke | 60/564 |
| 3,832,851 | 9/1974 | Kiernan | 60/563 |
| 3,842,789 | 10/1974 | Bergstedt | 440/61 |
| 3,915,111 | 10/1975 | Buddrus | 440/5 |
| 3,999,502 | 12/1976 | Mayer | 440/61 |

*Primary Examiner*—Sherman D. Basinger

[57] ABSTRACT

A hydraulic system for trimming a marine outboard drive, and wherein a single actuator for moving the propulsion unit is used for both trim and tilt. The actuator is connected to a hydraulic pump. A pump pressure amplifier is connected to the actuator. The amplifier has first and second ports connecting the actuator and to the hydraulic pump. The amplifier includes a switch for bypassing the amplifier to pass the hydraulic fluid from the pump to the actuator without amplification. The switch is operable for bypassing the amplifier for rapidly tilting the propulsion unit and operable for connecting the amplifier within the hydraulic circuit to develop increased pressure for trimming the propulsion unit. The hydraulic amplifier includes a piston movable within a cylinder. Movement of the hydraulic amplifier piston to one end of the hydraulic amplifier, cylinder actuates the switch to bypass the amplifier and movement in the other direction away from that end, switches and amplifier to its amplification mode, the amplifier continuing in its amplification mode until the amplifier piston reaches a limit switch placed in its path to bypass the amplifier hydraulic circuit.

13 Claims, 10 Drawing Figures

HYDRAULIC TRIM TILE SYSTEM FOR OUTBOARD PROPULSION UNITS USING A PRESSURE AMPLIFIER

This application is a continuation of application Ser. No. 070,378, filed Aug. 27, 1979, now abandoned.

FIELD OF THE INVENTION

This invention relates to the field of hydraulic amplifiers and to the use of a hydraulic amplifier to provide higher pressure and force to move objects such as an outboard propulsion assembly in a marine drive.

BACKGROUND OF THE INVENTION

Hydraulic trim tilt systems for outboard propulsion units are well-known. Further, such systems' units employing a single cylinder to displace the propulsion system such as rotating them through an arc are well-known. One such example is shown in U.S. Pat. No. 3,799,104.

U.S. Pat. No. 3,842,789 also shows a system for using a single cylinder for power trim and tilt. U.S. Pat. Nos. 4,064,824 and 4,096,820 both show systems for applying hydraulic forces to separate trim and tilt cylinders. Other patents showing hydraulic systems used with marine propulsion units are U.S. Pat. Nos. 3,885,517; 3,434,450 and 3,434,448.

All of the prior systems, U.S. Pat. No. 3,842,789 being an example, require a particular valving arrangement to change the amount of hydraulic pressure to the actuator and to rotate the propulsion unit through the trim and tilt range. In that patent, manual adjustment of a valve in the hydraulic supply lines is required. Although the object of this patent and of other patents is to provide a higher pressure to a system when requiring greater force and less rapid movement during trim operation and a lower pressure and more rapid movement during tilt operation, the prior devices either require separate actuator cylinders to rotate the propulsion unit through trim and tilt, or require special hydraulic switching systems to change the distribution area or the hydraulic fluid in the actuator.

DISCLOSURE OF THE INVENTION

This invention is a hydraulic system for moving, displacing or rotating a load for example, such as in a marine propulsion unit through its trim range and through a tilt range. In the trim range, when the boat is underway, and the angle of propulsion unit must be adjusted, a considerably greater force is required to displace the propulsion unit then to tilt it out of the water when power is removed. The trim range is limited with respect to the range of movement for the hydraulic propulsion unit. During trim, hydraulic fluid is provided to the hydraulic cylinder actuator unit with greater pressure and force and with a resultant slower movement of the hydraulic cylinder and the propulsion unit.

Accordingly, this invention uses a hydraulic amplifier which is connected in the hydraulic circuit between the hydraulic pump and the hydraulic actuator unit. The amplifier increases the pump pressure during the trim operation as necessary to increase the force to the hydraulic actuator connected to the propulsion unit. At the end of the trim range and start of the tilt range, the amplifier is bypassed and further displacement of the propulsion unit is then in the tilt range where the propulsion unit is then rapidly lifted clear of the water.

The hydraulic amplifier includes a displaceable or movable means which may be a piston and which has a displacement proportional to the displacement of the hydraulic actuator cylinder and the propulsion unit in the trim range. Movement of the piston within the amplifier to one end of its displacement path may correspond to movement of the propulsion unit to the end of its trim range and to the start of its tilt range.

At this point, a switch means such as a valve within the hydraulic amplifier and which may be mounted on the piston, bypasses the amplifier and connects the fluid from the hydraulic pump directly through to the actuator unit. The valve may be made responsive to differential pressure. The differential pressure will be large enough to open the valve when the load placed on the actuator cylinder is reduced or removed. In the system this will occur when the piston reaches the end of its displacement path and the load is removed from the actuator. The flow of the hydraulic fluid into the actuator unit is then at a lower pressure, but at a faster rate. As the propulsion unit at this point is to be tilted out of the water with power to propulsion unit being removed, less force is necessary and the lower hydraulic pressure moving at a higher velocity through to the actuator is sufficient to rapidly move the hydraulic actuator and the propulsion unit through its tilt range out of the water.

When it is desired to move the propulsion unit through its tilt range back into the water and into the trim range, the pump is reversed, displacing the fluid in the hydraulic system in the opposite direction and causing the actuator cylinder to rotate the propulsion unit downwards towards the water and correspondingly displacing the piston within the hydraulic amplifier. As stated above, the displaceable or movable means may be a slidable piston, moving within a cylinder. Movement of the fluid under the force of the pump forces the amplifier piston and actuator piston to be displaced as the actuator forces the propulsion unit in the opposite direction, the movement of the piston within the hydraulic amplifier corresponding to the movement of the actuator piston and of the propulsion unit.

The hydraulic amplifier includes a limit means which may be removed from an end and placed within the path of movement of the said amplifier piston or may be, but not necessarily at the other extreme end of its displacement path. When the amplifier piston reaches that limit means, the switch corresponding to the valve is actuated causing the amplifier to be bypassed such that fluid from the actuator flows directly through the amplifier, bypassing the amplifier and through to the pump. The continued operation of the pump then displaces the fluid from the actuator and through the hydraulic amplifier without amplification to further displace the hydraulic cylinder and the propulsion unit down through the balance of its tilt range. Continued operation of the pump forces the propulsion unit through the trim range until the extreme of the trim range is reached where further movement is prevented.

When during this movement of the propulsion unit in the downward direction, the pump is reversed, the hydraulic pressure in the system will force the amplifier piston to move away from the limit means and in the other direction along its displacement path and towards retarding means at the one end. At this point, the switch within the amplifier will be actuated connecting the amplifier within the hydraulic circuit, and providing hydraulic fluid with increased pressure but at a slower velocity to the hydraulic cylinder actuator.

In the contemplated use of this device, this part of the operation will take place after the system has been operated in reverse to bring the hydraulic propulsion unit from its full tilt position downward and to a position where it immersed in the water and where further reversal of the pump and fluid flow will be for the purpose of causing a desired trim.

In a system for providing hydraulic fluid at a first higher pressure to a hydraulic cylinder to move a propulsion unit through a trim range, and at a lower pressure but at a faster rate to move the hydraulic cylinder and a propulsion unit through a tilt range, a hydraulic amplifier is provided with means for switching the amplifier in and out of the hydraulic circuit to produce a change in pressure required for the respective trim and tilt operation.

This invention accomplishes its result by means of a novel arrangement of a switch being a valve mounted on the piston within the hydraulic amplifier and dispenses with external switches and control systems to alter the system from a trim to a tilt operation and visa-versa.

Additionally, this system uses a single hydraulic cylinder for both trim and tilt operations. Use of this single cylinder is made possible by the hydraulic amplifier and its internal valve arrangement. When the propulsion unit and the hydraulic cylinder has moved through a range corresponding to the trim range, the valve arrangement within the pressure amplifier is switched by differential fluid pressure and fluid at a lower pressure is provided directly to the actuator but at a faster rate for tilt operation.

The invention is described with reference to its use with a load such as a marine propulsion unit and particularly where the propulsion unit is tilted or rotated out of the water and where the unit may also be rotated through a trimming range when immersed in the water.

As is known, a marine propulsion unit, under drive, exhibits a strong force in one direction, tending to rotate or drive the propulsion unit towards the transom of the boat. Hydraulic systems are most commonly used to displace the propulsion unit forward and backward within a trim range when the propulsion unit is immersed in the water. When underdrive and to displace the propulsion unit away from the transom of the boat, a considerable force must be developed within a hydraulic actuator.

Where the propulsion unit is displaced through its trim range, further rotation or movement of the hydraulic propulsion unit then tilts the propulsion unit out of the water. For tilt, the drive is removed from the marine propulsion unit and less hydraulic pressure is required for the actuator to rotate or displace the propulsion unit through the balance of its range of movement and particularly through the tilt range.

With regard to this application and for reference purposes, movement of the propulsion unit from a position where it is closest to the transom of the boat, through its trim range, into and through its tilt range to its other extreme position out of the water, is defined as movement in a first direction. The first direction then is identified as movement of the propulsion unit through its trim range and its tilt range rotating it in an upper direction removing the propulsion unit from the water.

Accordingly, movement of the propulsion unit in the reverse or second direction would be downward towards the transom of the boat and through its tilt range and its trim position immersing the marine propulsion unit in the water.

BRIEF DESCRIPTION OF THE DRAWINGS

FIG. 1*a* showing the amplifier system with the piston at its limit means wherein the amplifier is bypassed. FIG. 1*b* showing the piston movable being midway between its limit means and its opposite end position in its displacement path and wherein it provides an amplified pressure to the actuator. FIG. 1*c* shows the amplifier piston at its end position and retarded and stopped from further movement and wherein the amplifier is bypassed to provide fluid to the actuator at the pump velocity and pump pressure, and FIG. 1*d* shows movement of the piston within the amplifier to its limit means responsive to movement of the actuator from its tilt position with the pump pressure reversed from that shown in FIGS. 1*a* through 1*c*.

DESCRIPTION OF THE PREFERRED EMBODIMENT

Figure 1A:
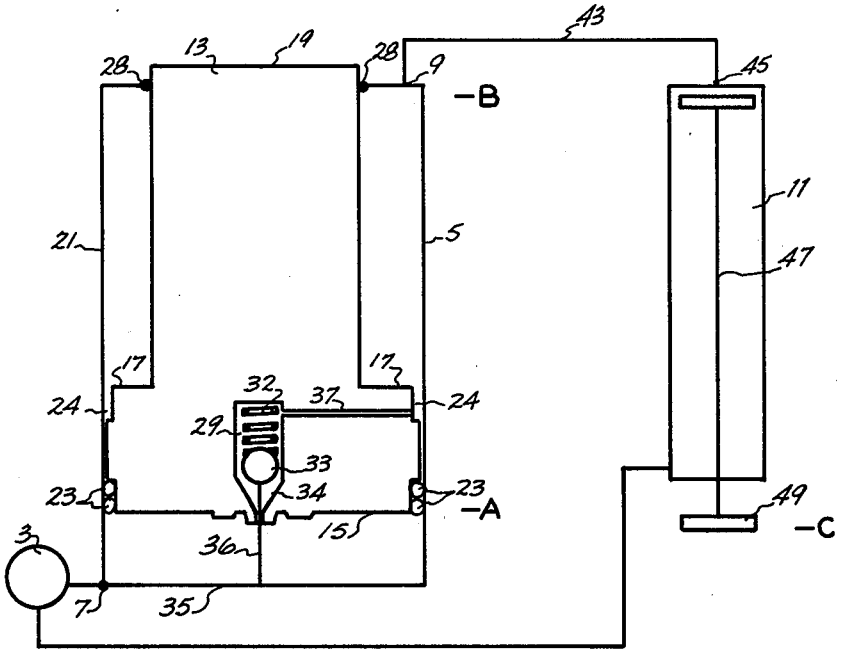
FIGS. 1*a* through 1*d* show in schematic form, the system in various stages of displacement.

FIGS. 1*a*, 1*b*, 1*c* and 1*d* shows operation of the hydraulic system in a first direction, proceeding through the trim range to the tilt range to a full extension of the hydraulic actuator cylinder where the propulsion unit is in its full tilt position.

The hydraulic unit is shown in schematic form and wherein the same numerals indicate the same and similarly operating parts.

As shown, a hydraulic pump 3 provides fluid to a hydraulic amplifier indicate generally as 5. The hydraulic amplifier 5 has a first port 7 connected to the pump 3 and a second port 9 connected to the hydraulic actuator cylinder shown as 11. The hydraulic amplifier 5, as is well-known, has a displaceable means piston which may be an amplifier piston 13, having a first surface defining a face having an annular surface area with cross section area 15 shown in FIG. 2*b* and a second surface defining a face having an annular surface area with cross-sectional area 17, shown in FIG. 2*c*, area 17 being an annular area represented by the difference between the area of face 15 of the piston 13 and the area of face 19 of piston 13, shown in FIG. 2*a*.

The piston 13 is displaced or moves within the cylinder assembly 21 of the hydraulic amplifier 5 between a first extreme position at the top of the amplifier cylinder 21 shown as position B and a second extreme position shown as position A at the bottom of the amplifier 21.

It being understood that the terms top and bottom are used for reference purposes only and this invention in no way requires that the hydraulic cylinder be aligned as shown in the drawing with respect to top and bottom.

Seals 23 and 28 are provided for allowing movement of the amplifier piston 13 within the cylinder 21 without loss of fluid and without fluid communication between that volume bound by face 15 of piston 13 and that volume bound by face 17 of piston 13.

The piston 13 is shown as having a switch means 29 which may be a valve assembly as shown having a valve body 33 and valve seat 34, a means for closing the valve shown as spring 32 and means for opening the valve shown as plunger 36 positioned to contact a limit means shown as bottom wall 35 of cylinder 21.

The fluid may be communicated to the actuator cylinder 11 through port 9 of the cylinder 21 conduit 43 and port 45 within the cylinder 11.

Operation in the system is described assuming that the load 49 is at its fully downwardly extended position with the hydraulic cylinder 11 and the load propulsion unit 49, being at level C at one end of the trim range.

Assuming now that the pump 3 is operated in a first direction to apply pressure to the system, fluid under pressure is applied to the hydraulic amplifier 5 through port 7 and to that volume adjoining the surface 15 of piston 13.

Although the plunger 36 in contact with the bottom of the amplifier cylinder 35 as shown in FIG. 1*a*, forces the switch or valve means 29 to open, communicating the volume of the amplifier cylinder adjoining face 15 of piston 13 to the volume of the cylinder adjoining face 17 of the piston 13 sufficient force is developed due to the differences in affected surface area to move the piston 13 up towards position B from the position A shown in FIG. 1*a*.

Figure 1B:
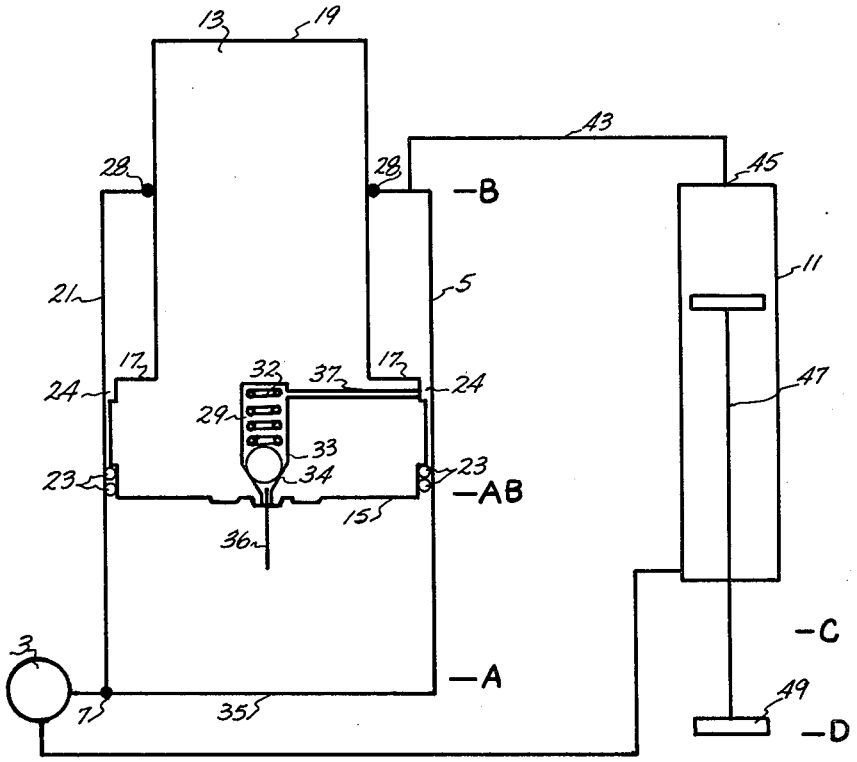

As shown in FIG. 1*b*, movement of the piston from position A to position A-B between extreme positions A and B correspondingly moves the plunger 31 from the bottom 35 of the amplifier allowing the valve body 33 to close under the force of the valve closing means shown as spring 32.

During this time when the amplifier piston 13 is moving between end position A and end position B as shown in FIG. 1*b*, the valve will be closed under the force of spring 32 and the area or volume within the amplifier cylinder adjoining face 15 of piston 13 will be isolated from the area adjoining face 17 of piston 13. With the valve means 29 closed, movement of the amplifier piston 19 will force fluid from the amplifier cylinder 21 through port 9 to the hydraulic actuator cylinder 11 and displace the hydraulic actuator cylinder from its initial rest position to a new position D shown as in FIG. 1*b*.

During the time the amplifier piston is moving, the pressure within the hydraulic cylinder 5 will be an amplified pressure relative to the pressure of the pump. As is well-known in hydraulic amplifiers, the pressure at port 9 will be equal to the pump pressure multiplied by the ratio of the surface area of face 15 of piston 13 to the surface area of the annular surface 17 of piston 13.

During movement of the piston, the force produced by the differential pressure between the volume adjoining surface 17 and the volume adjoining surface 15 will be less than the force of the valve closing means 32 within valve means 29 and the valve will be maintained closed as shown in FIG. 1*b*.

Figure 1C:
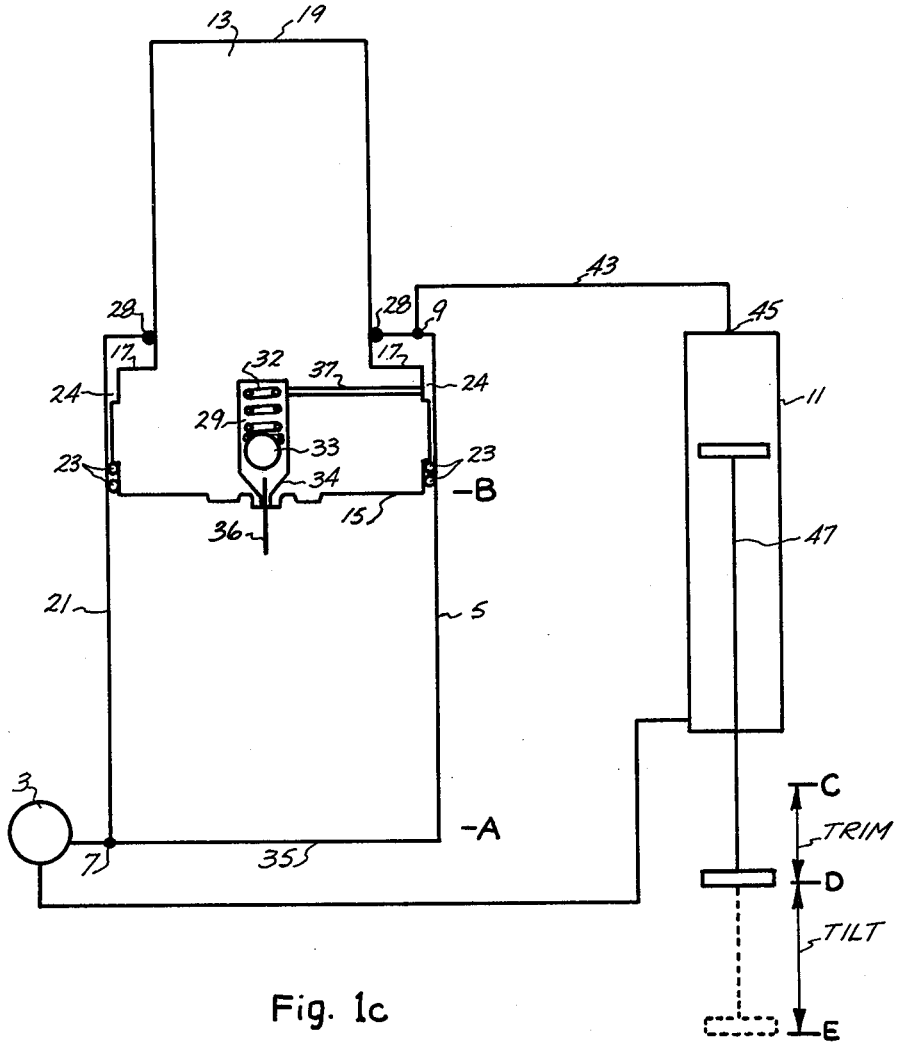

In FIG. 1*c*, the amplifier piston 13 has been moved to one end of its displacement path at position B. When this point is reached, the amplifier is constructed with retarding means so that further mechanical displacement of the piston 13 is not possible in the direction from A to B. At this point, and assuming power to the propulsion unit is removed the differential pressure between the fluid in the volume bound by face 15 and the volume bound by annular face 17 will force the valve body 33 to move against the force of spring 32, permitting communication between that volume bounded by face 15 and the volume bounded by face 17. The further operation of the pump in the first direction, forces fluid from the pump 3 through port 7 of amplifier 5 through the valve assembly 29 and conduit 37, through the volume of the amplifier cylinder 21 adjoining surface 17, through port 9 of amplifier 21, and conduit 43 connecting the amplifier to the hydraulic cylinder 11 at port 45.

When the piston 13 of the hydraulic amplifier is moved to and retarded in its extreme position B, and the differential pressure opens valve means 29, allowing communication of the fluid through the amplifier 5 without amplification, the fluid is then moved at a lower pressure but at the velocity of the pump further displacing the piston 47 within the hydraulic cylinder 11 from position D to position E as shown in FIG. 1*c*.

As explained above, where the propulsion unit shown as load 49 is at its lowest position shown as C in FIG. 1*a*, initial displacement corresponding to the displacement between A and B of the amplifier piston 13 will be through the trim range position, the displacement being C to D of the piston 47 and the propulsion unit 49.

When the amplifier piston is at position B, and with the valve 29 open as explained above, the pump will be connected directly through to the hydraulic cylinder 41 bypassing the hydraulic amplifier 5. The fluid within the system will be moved at the pump velocity but at the lower pump pressure, directly to the hydraulic actuator and will rapidly move the actuator and the propulsion unit from position D to E representing the tilt range.

Figure 1D:
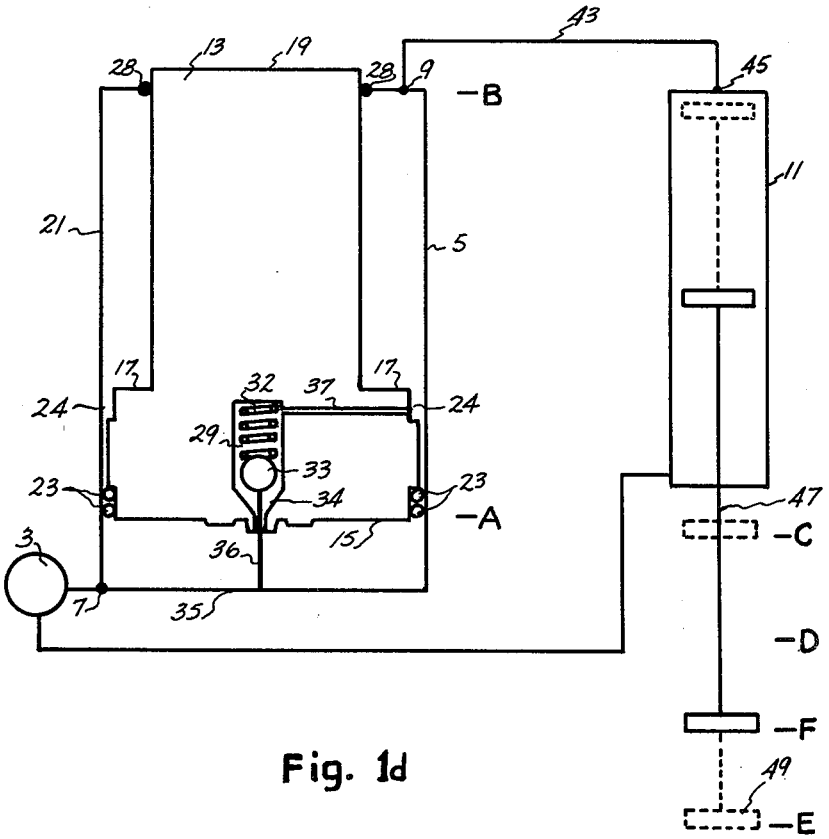
Figure 4:
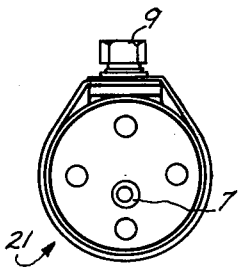
FIG. 4 shows the amplifier assembly in an end view.

Operation of the device is now shown with reference to FIG. 1*d* wherein the propulsion unit 49 shown as position 1 in phantom at the extreme end of its tilt position, is lowered through its tilt range and its trim range, back to its extreme from position C.

As can be seen in FIG. 1*c*, when the pump 3 is stopped or reversed, the differential pressure existing at face 15 of the amplifier piston 13 will no longer maintain the valve 29 in valve assembly open, valve 29 will close connecting the hydraulic amplifier 5 in the hydraulic circuit, so the hydraulic amplifier piston 13 is displaced downwardly in a second direction from position B towards position A. As the hydraulic amplifier piston 13 moves from position B to A, a corresponding displacement of the actuator piston 47 and the propulsion unit 49 from its extreme tilted position E to an intermediate position shown as F will take place corresponding to the movement of the piston within the hydraulic amplifier from B to A.

As explained above at position A, the force of the plunger 36 against the limit means shown as the bottom 35 of the cylinder 21 of the amplifier 5 will open the valve 29 allowing communication of the actuator cylinder 11 through port 9, conduit 37, the valve 29 and port 7 of the amplifier 5 through to the pump 3. As the valve will be open under the force of plunger 36, the amplifier will be bypassed and switched out of the hydraulic circuit, and the piston 47 of the hydraulic actuator 11 will be moved under the direct force of the pump and with the velocity of the pump through to its other extreme bottom and moving the propulsion unit 49 to position C.

Operation of the pump in the reverse direction with the unit within its tilt range at F for example, and with piston 13 at B will cause displacement of the fluid, moving the piston 47 within the hydraulic actuator cylinder 11 and moving the propulsion unit 49.

Movement of the pump in the second direction then displaces or rotates the propulsion unit downward towards the water, and continued movement and operation of the pump displaces the propulsion unit 49 to the trim range between positions C and D. When the propulsion unit is located in the trim range, operation of the pump in the first direction will cause movement of the hydraulic amplifier piston 19 away from the limit means shown as the bottom wall 35, removing the force of the opening means shown as plunger 36 from the valve 33 closing the valve under the force of closing means shown as spring 32 and placing the amplifier within the hydraulic circuit. The amplifier then provides an amplified pressure to permit displacement of the load shown as a propulsion unit 49 to effect proper trimming of the propulsion unit.

Operation of the pump in the reverse direction with the unit within its tilt range at F for example, and with piston 13 at B will cause displacement of the fluid, moving the piston 47 within the hydraulic actuator cylinder 11 and the propulsion unit toward position C.

The amplifier piston 13 will also experience corresponding movement until it reaches a limit means where the valve 33 will open allowing direct communication of the hydraulic actuator cylinder 11 with the pump 3 and rapid movement of the piston 47 and the associated propulsion unit 49 at the speed and pressure of the pump 3.

In the described operation of the amplifier 5, valve 33 opens when the piston reaches position A. However, it should be understood that position A is not necessarily at an end or limit of the displacement path of the piston 13 within the amplifier.

As will be understood by one skilled in the art, a limit means for contacting a means to open valve 33 can be placed within the hydraulic amplifier 5 to open the valve 33 before the piston 19 reaches position A. For example, a contact means can be placed within the amplifier 5 which contacts the plunger 36 when the piston assembly is somewhere between position B and A.

It should be understood that the limit means shown as bottom wall 35 in this embodiment, may be placed anywhere along the path of the piston 13 between position A and position B and may be any suitable means which contacts the actuator means shown as plunger 36 responsive to movement of the piston 13 towards the limiting means, and wherein further movement of the piston 13 in the same direction towards the limiting means, forces the actuator means against the valve, opening the valve and allowing communication between the two volumes.

Figure 2:
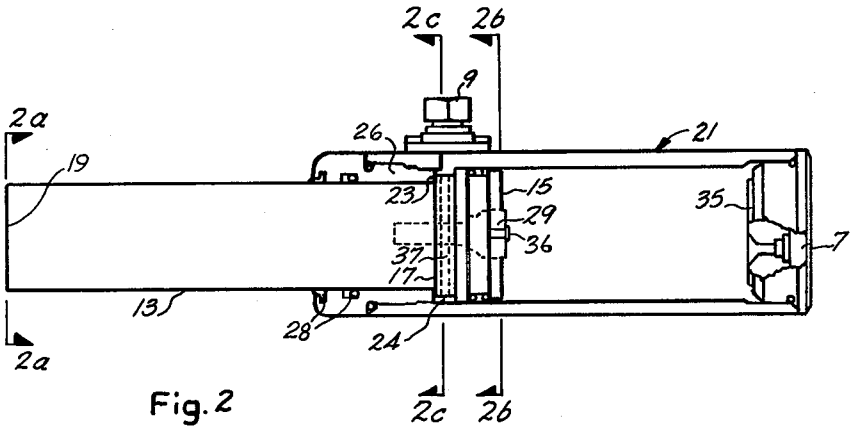
FIG. 2 shows in cross section, the amplifier assembly with the piston at one end at its stopped position.
Figure 2C:
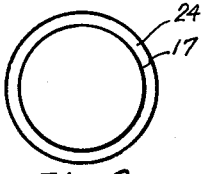
FIGS. 2*a*, 2*b* and 2*c* show in cross-section the surfaces of the piston at various positions along its axial length.
Figure 2B:
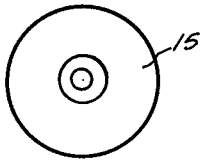
Figure 2A:
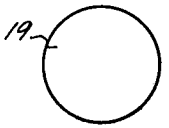
Figure 3:
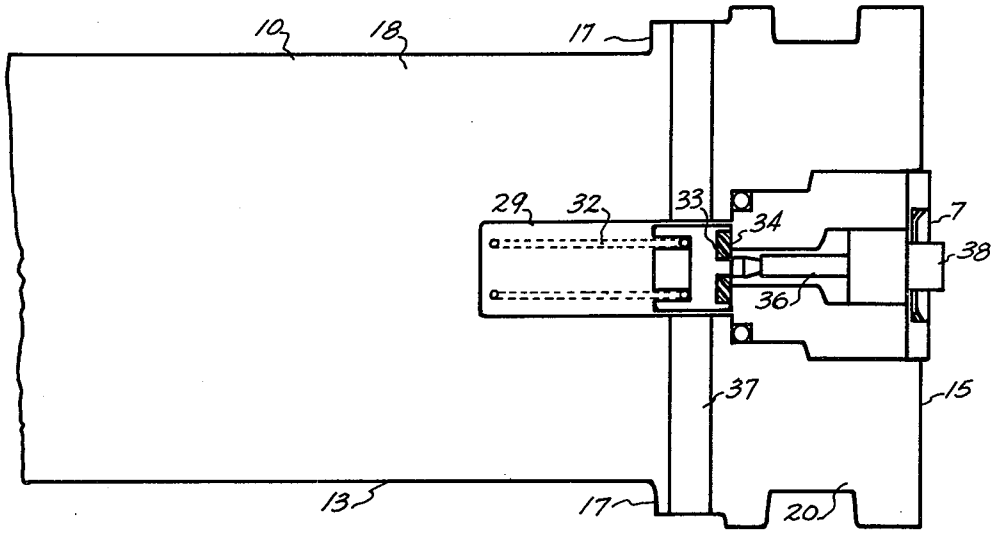
FIG. 3 shows in cross-section, a detail of the switch means, being a hydraulic valve within the amplifier piston.

Operation of the amplifier is now shown with reference to FIGS. 2 and 3 wherein a detail of the valve assembly 29 is shown.

The valve is mounted in the displaceable piston 13 and includes a means shown as spring 32 forcing valve body 33 against valve seat 34. An actuator means for opening the valve is shown as a plunger 36 having an end 38 protruding below the surface 15 of the piston to engage a limit means such as the bottom wall 35 of cylinder 21.

Movement of the amplifier piston 13 towards position A places the plunger 36 in contact with the bottom wall 35 of the amplifier cylinder. The plunger 36 then displaces valve body 33 against valve spring 32 opening the valve and permitting fluid to flow from the volume bounded by surface 17 through conduit 37, valve seat 34 and valve body 33, through to port 7. A small annular space 24 may be left between piston 13 and the inner wall of cylinder 21 to permit fluid to flow out conduit 37.

It should be noted that it is not necessary for the piston to be displaced to the bottom or to the bottom wall 35 of the amplifier cylinder 21 as any suitable means for contacting the plunger 36 and forcing the plunger against the valve body 33 and against the force of the spring 32 to open the valve 29 may be used. For example, a suitable mechanical structure may be placed close to position A and removed from position B to contact the plunger 36 and open the valve before the plunger 36 reaches the bottom wall 35 of the cylinder. However, the bottom wall is a convenient place for locating the limit means for the valve and for that reason is shown as such in the preferred embodiment.

Further, it should be known that a plunger is not required as any suitable actuating means may be used, responsive to movement of the piston, to contact the valve, and open the valve. For example, a structure stationarily mounted in the cylinder, and located in the path of the valve so it contacts the valve body when the valve reaches a corresponding limit position, opening the valve and communicating the volume bounded by surface 15 to the volume bounded by surface 17.

As hydraulic fluid is driven in a first direction, the differential force against the surface 15 forces the piston to be displaced towards position B from position A, moving the piston away from bottom wall 35 and allowing the valve to close. The piston is then displaced up until the point where the annular surface 17 contacts the stop or retarding means located in the cylinder 21. At this point, and assuming no power is provided to the drive unit, the differential pressure on the plunger side of the valve compared to the force of the spring against the valve opens the valve and provides hydraulic fluid under the speed and pressure of the pump to the hydraulic actuating cylinder 11 to displace the cylinder through its tilt range. When the pump is stopped or reversed, the differential pressure forcing the valve open is removed and spring 32 forces the valve closed.

However, if power is supplied to the propulsion drive unit, the force of the pump by itself will be insufficient to displace the hydraulic cylinder against the force of the propulsion unit and the system will go into hydraulic stall or fluid will be directed through a conventional bleed or pressure relief valve (not shown).

With the piston of the hydraulic amplifier located at position B, operation of the hydraulic pump in the second direction displaces fluid from the hydraulic cylinder to the amplifier, and to the volume defined by surface 17 displacing the piston from position B to position A. When the piston reaches the limit means, plunger 36 is forced against the valve body 33, and opens valve and permitting fluid to flow around the valve seat 34, fluid under the speed and pressure of the pump is forced to the hydraulic cylinder allowing the hydraulic cylinder to move its end position where the hydraulic unit is placed to its fully lowered position in the water, corresponding to position C in FIG. 1.

The principles of this invention have been shown with reference to the preferred embodiment, but should not be limited to the description of this embodiment as shown.

For example, the manner of opening the switch means mounted in the movable portion of the amplifier, by driving the movable means to one end of its path may be changed to any other suitable arrangement. One possible arrangement would be to place a limit means in the path of the movable means, a limit distance from the end of the path. In this way, the amplifier could have two limit means, neither at the end of the path, or one limit means which may or may not be at the end of the path, with the the switch being opened by the third pressure when it is at the respective other end of the path, or the switch may be operated by the fluid under pressure at both ends of the path.

We claim:

1. A system for trimming and tilting an outboard propulsion unit having a hydraulic means for developing hydraulic pressure, displaceable means connected to said hydraulic means for trimming and tilting said propulsion unit in response to said hydraulic pressure, means for amplifying said pressure connected to said displaceable means and said hydraulic means, said amplifier means having a first and a second port, said first port being connected to said hydraulic means, said amplifier means including switch means within said amplifier means, and responsive to a pressure differential for bypassing said amplifier means and connecting said hydraulic means to said displaceable means substantially without amplification for tilting said propulsion unit substantially without increased pressure and said switch means connecting said amplifier means between said displaceable means and said hydraulic pressure means to increase said pressure for trimming said propulsion unit.

2. The system of claim 1 wherein said switch means is in a first state for tilting said propulsion unit and said switch means changes state in the absence of said pressure from said hydraulic means to enclose a volume of fluid within said amplifier means, said enclosed volume of fluid holding said displaceable means against further movement.

3. The system of claim 2 wherein said switch means is a valve which opens in response to said hydraulic means developing said pressure and closes when said hydraulic means is inactive removing said pressure.

4. The system of claim 1 wherein said amplifier means includes a movable means movable along a movement path, said movement path having first and second ends and said switch being mounted in said movable means and operable to bypass said amplifier in response to said pressure differential across said switch means.

5. The system of claim 4 wherein said amplifier includes a limit means placed along said path, said switch means having means for engaging said limit means to operate said switch and to bypass said amplifier when said engaging means is driven against said limit means.

6. The system of claim 5 wherein said switch means in a second state isolates said first port from said second port, said amplifier means amplifying the hydraulic pressure of said fluid received at said first port, and providing an amplified pressure at said second port and to said displaceable means in response to said switch means being in said second state.

7. The system of claim 6 wherein said displaceable means is effective to trim said propulsion unit in response to said amplified hydraulic fluid pressure at said second port, when said propulsion unit is operating and effective to tilt said propulsion unit in response to said fluid at the second port of said amplifier means, when said propulsion unit is inoperative.

8. The system of claim 6 wherein said fluid at said amplified pressure is connected to said displaceable means, said displaceable means being displaced under the force of said fluid at said second port.

9. The system of claim 8 wherein said displaceable means moves responsive to said fluid at the second port of said amplifier means with a displacement proportional to the displacement of said movable means within said amplifier between said first end and said limit means, to trim said propulsion unit.

10. The system of claim 9, wherein said movable means moves responsive to a fluid pressure at said second port with a displacement proportional to the displacement of said displaceable means and responsive to the pressure at said second port being higher than said pressure at said first port.

11. The system of claim 10, wherein said switch is operable to bypass said amplifier when said movable means reaches said limit means in said amplifier to provide a fluid path for said fluid through said amplifier substantially without amplification.

12. A hydraulic amplifier for amplifying pressure of a hydraulic fluid:

said hydraulic amplifier including a cylinder assembly having a cylinder with a longitudinal axis and a piston including a rod integral therewith and protruding from a first surface thereof and movable in a displacement path parallel to said longitudinal axis within said cylinder, said rod protruding through a first end of said cylinder;

said first surface of said piston having a substantially smaller surface area than a second surface of said piston parallel to said first surface;

said piston dividing the interior of said cylinder into a first chamber and a second chamber;

said cylinder including a first port in communication with said first chamber and a second port in communication with said second chamber, said first chamber being adjacent said second surface, and said second chamber being adjacent said first surface;

said piston defining a first passage parallel to said longitudinal axis in said second surface and in communication with said first chamber and further defining a second passage perpendicular to and intersecting said first passage, said second passage being proximate to said first surface;

said piston further defining an annular space between the radial periphery of said piston and the interior of said cylinder adjacent said first surface, said second passage being in communication with said annular space and with said second chamber;

valve means being disposed in said first passage, said valve means including a plunger protruding from said second surface, said valve means being resiliently biased to a closed position and openable by a predetermined hydraulic pressure in said first chamber with respect to the hydraulic pressure in said second chamber and by mechanical movement of said plunger towards said second surface;

said piston being movable in a first direction in response to hydraulic pressure applied to said first port to amplify the hydraulic pressure present in said second chamber and at said second port;

said cylinder including stop means for stopping said piston adjacent said first end of said cylinder, said valve being opened by said predetermined hydraulic pressure in said first chamber to provide said predetermined hydraulic pressure to said second chamber and said second port;

said piston being movable in a second direction in response to hydraulic pressure applied to said second port, said valve being closed when said piston is moved in said second direction;

said cylinder including means for contacting said plunger to open said valve adjacent a second end of said cylinder;

said piston moving in said second direction in response to hydraulic pressure applied to said second port until said valve is opened by said means for contacting said plunger to provide said hydraulic pressure applied to said second port to said first port.

13. A system for trimming and tilting an outboard propulsion unit, including:

a hydraulic pump means for developing hydraulic pressure;

a hydraulic lift cylinder means operably connected to said pump means for trimming and tilting said propulsion unit in response to said hydraulic pressure;

hydraulic pressure amplifier means interposed between said pump means and said hydraulic lift cylinder for trimming said propulsion unit;

said hydraulic amplifier including a cylinder assembly having a cylinder with a longitudinal axis and a piston including a rod integral therewith and protruding from a first surface thereof and movable in a displacement path parallel to said longitudinal axis within said cylinder, said rod protruding through a first end of said cylinder;

said first surface of said piston having a substantially smaller surface area than a second surface of said piston parallel to said first surface;

said piston dividing the interior of said cylinder into a first chamber and a second chamber;

said cylinder including a first port in communication with said first chamber and a second port in communication with said second chamber, said first chamber being adjacent said second surface, and said second chamber being adjacent said first surface;

said piston defining a first passage parallel to said longitudinal axis in said second surface and in communication with said first chamber and further defining a second passage perpendicular to and intersecting said first passage, said second passage being proximate to said first surface;

said piston further defining an annular space between the radial periphery of said piston and the interior of said cylinder adjacent said first surface, said second passage being in communication with said annular space and with said second chamber;

valve means being disposed in said first passage, said valve means including a plunger protruding from said second surface, said valve means being resiliently biased to a closed position and openable by a predetermined hydraulic pressure in said first chamber with respect to the hydraulic pressure in said second chamber and by mechanical movement of said plunger towards said second surface;

said piston being movable in a first direction in response to hydraulic pressure applied to said first port to amplify the hydraulic pressure present in said second chamber and at said second port;

said cylinder including stop means for stopping said piston adjacent said first end of said cylinder, said valve being opened by said predetermined hydraulic pressure in said first chamber to provide said predetermined hydraulic pressure to said second chamber and said second port;

said piston being movable in a second direction in response to hydraulic pressure applied to said second port, said valve being closed when said piston is moved in said second direction;

said cylinder including means for contacting said plunger to open said valve adjacent a second end of said cylinder;

said piston moving in said second direction in response to hydraulic pressure applied to said second port until said valve is opened by said means for contacting said plunger to provide said hydraulic pressure applied to said second port to said first port;

said hydraulic amplifier having said first port connected to a first port of said pump means and said second port connected to a first port of said cylinder means, said cylinder means having a second port connected to a second port of said pump means to form a hydraulic circuit;

said piston moving in said first direction to provide an amplified pressure adapted for trimming said propulsion unit against the propulsive force of said propulsion unit, said valve means opening in response to said predetermined pressure to provide an unamplified pressure to said cylinder means for tilting said propulsion unit;

said piston moving in said second direction to lower said propulsion unit, said valve means being opened by contact with said means for contacting said plunger to further lower said propulsion unit.

* * * * *